US006042026A

United States Patent [19]

Buehler, II

[11] Patent Number: 6,042,026

[45] Date of Patent: Mar. 28, 2000

[54] SPRAY NOZZLE

[76] Inventor: Louis C. Buehler, II, 2724 Woodwind Way, Indianapolis, Ind. 46268

[21] Appl. No.: 09/109,642

[22] Filed: Jul. 2, 1998

[51] Int. Cl.[7] ..... B05B 7/32

[52] U.S. Cl. ..... 239/346; 239/434

[58] Field of Search ..... 239/318, 346, 239/434

[56] References Cited

U.S. PATENT DOCUMENTS

| | | | |
|---|---|---|---|
| 2,543,294 | 2/1951 | McCabe . | |
| 2,571,871 | 10/1951 | Hayes | 103/262 |
| 3,113,725 | 12/1963 | Packard et al. | 239/318 |
| 3,122,325 | 2/1964 | Mahrt et al. | 239/318 |
| 3,539,111 | 11/1970 | Johnson | 239/318 |
| 3,632,046 | 1/1972 | Hengesbach | 239/318 |
| 3,716,194 | 2/1973 | Miller | 239/318 |
| 3,770,209 | 11/1973 | Wilcox | 239/434 |
| 4,193,550 | 3/1980 | Juttelstad et al. | 239/314 |
| 4,527,740 | 7/1985 | Gunzel, Jr. et al. | 239/318 |
| 5,529,244 | 6/1996 | Horvath, Jr. et al. | 239/318 |
| 5,626,291 | 5/1997 | Flinn et al. | 239/318 X |
| 5,693,226 | 12/1997 | Kool | 239/434 X |

OTHER PUBLICATIONS

P. 3877 from *Guardair Catalog*; Safety Air Guns & Pneumatic Accessories.

P. 219 from unknown catalog; Blow Guns.

P. 225 from Coilhose Catalog; Air Guns.

P. 7 from *Coilhose Catalog*, Special Appplication Blow Guns.

Pp. 4 and 5 from *Milton Catalog*; Blo–Guns—100 Series.

*Compressed Air and Gas Handbook*; Rollins, Compressed Air and Gas Institute, Fourth Edition, 1973.

*Primary Examiner*—Lesley D. Morris

*Attorney, Agent, or Firm*—Woodard, Emhardt, Naughton, Moriarty & McNett

[57] ABSTRACT

A spray nozzle for improved siphon or nozzle flow rate performance comprises four passageways configured to take advantage of the venturi effect. The first passageway is adapted for receiving a first pressurized fluid from a first source which is pressurized by a compressor. The first passageway exits to a second passageway with a reduced cross-sectional area which in turn has an outlet into the third passageway. A fourth passageway is connected to the third passageway near the outlet of the second passageway. The ratio of the diameter of the third passageway over the diameter of the second passageway is greater than 2.7 in combination with an exit angle of the outlet tube between 1.1 to 5.7 degrees.

23 Claims, 5 Drawing Sheets

SPRAY NOZZLE

BACKGROUND OF THE INVENTION

This invention relates in general to spray nozzles and in particular to spray nozzles which use a venturi effect to mix two fluids.

Spray nozzles are widely used for spraying various commodities, including such things as paint, cleaning agents and solutions, and water. Many prior art spray nozzles force a fluid such as air through a converging/diverging venturi configuration. A low pressure region is formed at the location of the minimum diameter of the venturi, which according to the well-known Bernoulli theorem, corresponds to the maximum velocity of the fluid. Coupled to the spray nozzle at or near the low pressure region of the venturi is a liquid inlet passage through which a liquid is drawn into the fluid stream.

One example of a prior art spray nozzle is embodied in U.S. Pat. No. 3,770,209 to Wilcox, which is incorporated herein by reference. The liquid inlet passage is coupled with an expanding portion of the nozzle that is located downstream from the diverging portion of the venturi, rather than that portion of the venturi which has fluid at the maximum velocity. Further, the performance of a spray nozzle may be improved by controlling design parameters such as the ratio of the width of the receiving passage to the width of the air inlet passage, to be in the range of 1.6 and 2.5 along with the ratio of the distance between the downstream edge of the opening of the liquid inlet passage and the width of the receiving passage to be less than approximately 2.0.

Heretofore, there has been a need for a spray nozzle with design parameters allowing increased rates of speed of the nozzle, where the speed of the nozzle is defined by the amount of time it takes to evacuate a quart jar attached to the liquid inlet passage, with minimal regard to the flow rate of air in cubic feet per minute ("CFM") being used. The present invention satisfies this need in a novel and unobvious way.

SUMMARY OF THE INVENTION

In one embodiment the spray nozzle comprises a main body having a first, second, third, and fourth passageways. The first passageway has a first inlet and a first outlet and a first width. The first inlet is adapted for receiving a first pressurized fluid from a first pressure source. The second passageway has a second inlet and a second outlet and a second width. The third passageway has a third inlet and a third outlet and a third width. The fourth passageway has a fourth inlet and a fourth outlet and a fourth width. The fourth inlet is adapted for receiving a second fluid from a second source. The fourth outlet is connected to the third passageway near enough to the third inlet so that the second fluid is drawn into the third passageway and mixes with the first fluid. The third outlet exits to the surrounding atmosphere. The first, second, and third passageways are in end to end fluid communication with one another. The exit ratio of the third width divided by the second width is greater than 3.

In another aspect of the invention the spray nozzle comprises a first, second, third, and fourth duct with a first, second, third, and fourth inlet, outlet, and width respectively. The first, second, and third ducts are in end to end fluid communication with one another. The first inlet is adapted for receiving a first pressurized fluid from a first pressure source. The fourth inlet is adapted for receiving a second fluid from a second source. The fourth outlet is connected to the third duct near enough to the third inlet so that the second fluid is drawn into the third duct and mixes with the first fluid. The third outlet exits to the surrounding atmosphere. The nozzle has an exit ratio defined by the third width divided by the second width. The third duct has an exit angle defined between a first line and a coplanar second line. The first line is located at a radius of the second passageway and parallel to the centerline. The second line connects a first point on the circumference of the second outlet to a second point on the circumference of the third outlet. The second line intersects the first line only at the second outlet. The exit angle is between 2.2 to 5.7 degrees, and the exit ratio is greater than 2.7.

In another aspect the spray nozzle comprises a first, second, third, and fourth passageway having a first, second, third and fourth inlet, outlet, and width respectively. The first inlet is adapted for receiving a first pressurized fluid from a first pressure source. The fourth inlet is adapted for receiving a second fluid from a second source. The passageways are configured so that the second fluid is drawn into the third passageway by a venturi effect. The nozzle has means for maximizing the delivery of the second fluid into the third passageway.

One object of the present invention is to provide an improved spray nozzle.

Related objects and advantages of the present invention will be apparent from the following description.

DESCRIPTION OF THE PREFERRED EMBODIMENT

Figure 1:
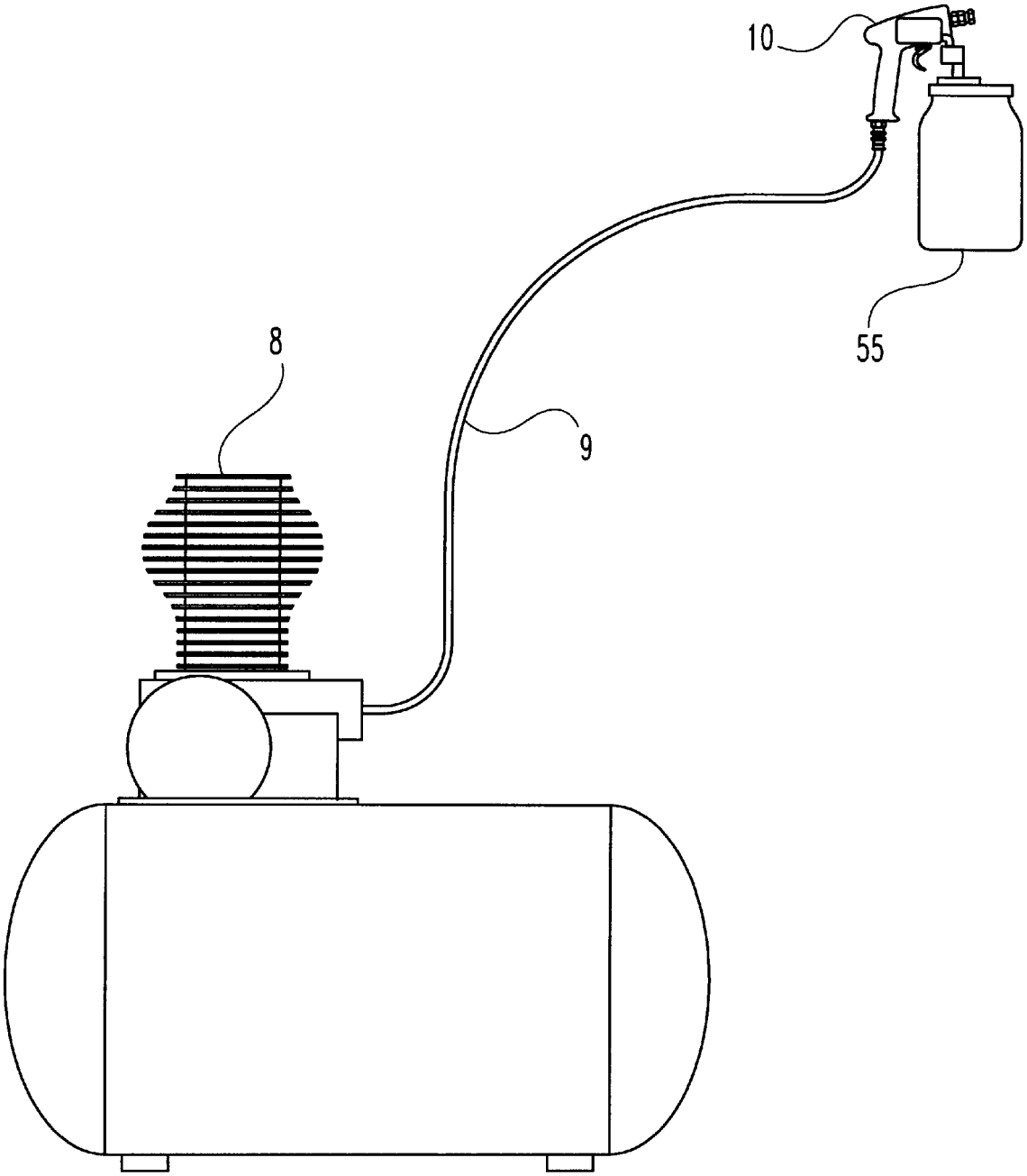
FIG. 1 is an illustrative view of a spray system incorporating a nozzle of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, any alterations and further modifications in the illustrated device, and any further applications of the principles of the invention as illustrated therein being contemplated as would normally occur to one skilled in the art to which the invention relates.

Figure 2:
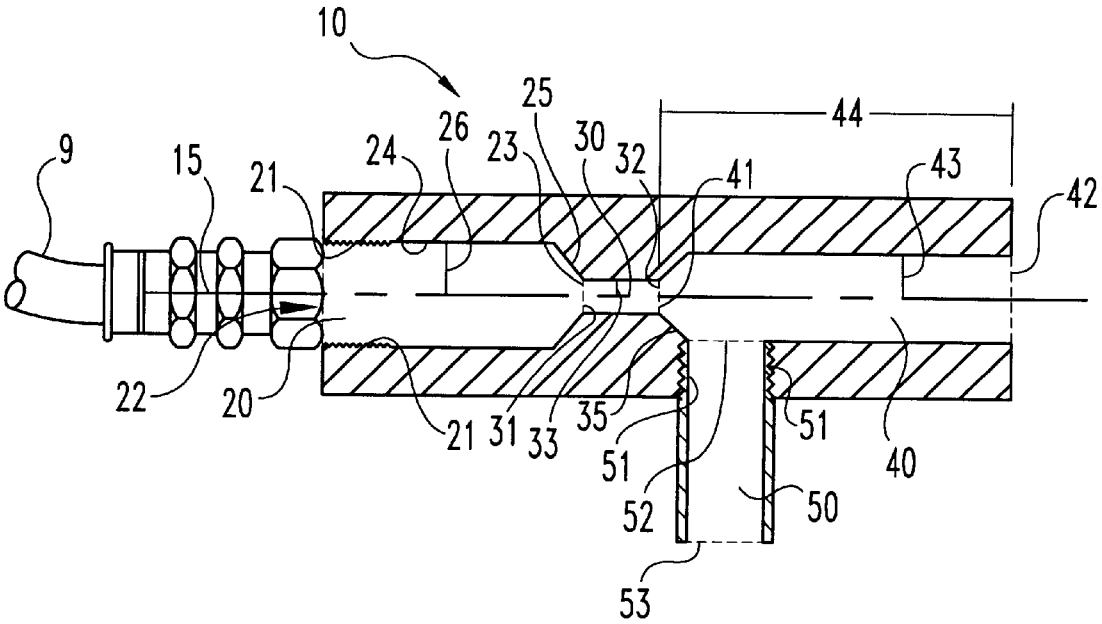
FIG. 2 is a partial sectional view of a spraying sytem including a single stage spray nozzle of one embodiment of the present invention.
Figure 3:
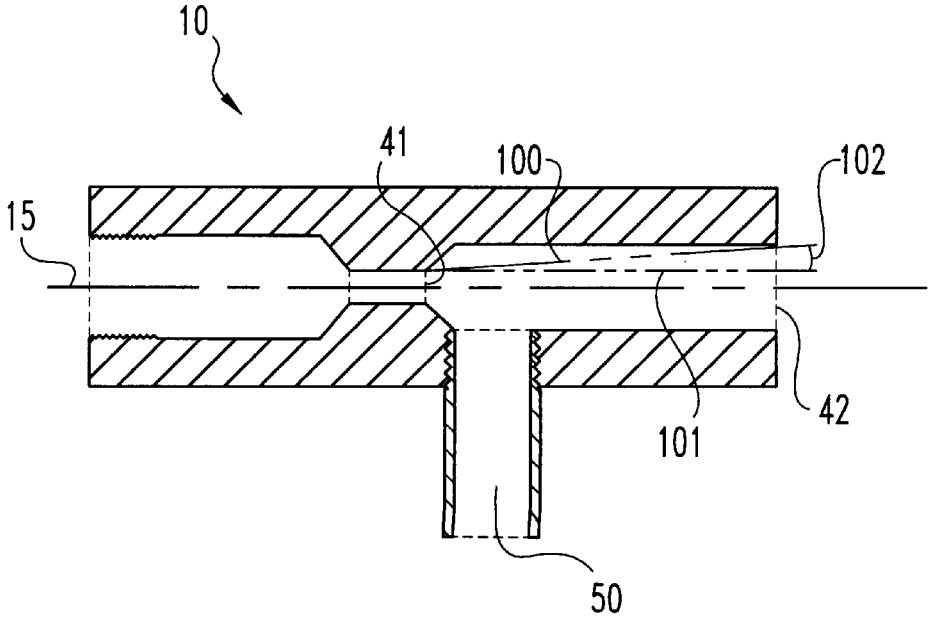
FIG. 3 is a partial cross sectional view of the single stage spray nozzle comprising a portion of the FIG. 2 spraying system.

With reference to FIGS. 1–3 there is illustrated a spray nozzle member 10 with four passageways or ducts 20, 30, 40 and 50. The first passageway 20 is connected to feed line 9 of a first source of fluid preferably a gas and more preferably air, charged to greater than atmospheric pressures by a compressor 8. First passageway 20, preferably cylindrical, has a wall portion 24 with a radius 26 connecting an inlet 22 and an outlet 23. First passageway 20 extends along a longitudinal axis defined by a centerline 15. First passageway 20, second passageway 30, and third passageway 40 are all co-axial and centered on the centerline 15. First passageway 20 preferably has a threaded portion 21 on its circumference adjacent to inlet 22 for receiving therein a mating threaded surface on feed line 9 connecting first passageway 20 to the first source of fluid and compressor 8. Alternatively, feed line 9 may have a snap on coupling to attach to nozzle member 10 at inlet 22 or otherwise be attached by adhesives, screws, clips and other means known in the art. Outlet 23 of first passageway 20 exits into the inlet 31 of the second passageway 30.

The second passageway 30 is a reduced diameter nozzle area with a radius 33 and outlet 32. Wall portion 24 preferably has a tapered transition surface 25 of decreasing diameter connecting the first passageway 20 and second passageway 30. It is also preferable to have a tapered transition surface 35 of increasing diameter connecting the second passageway 30 and the third passageway 40. It is understood that a ninety degree or even a greater than ninety degree transition from one passageway to the next is contemplated as within the scope of the invention.

In another embodiment the second radius 33 of the second passageway 30 is equal to the first radius 26 of inlet tube 20. If the first radius 26 and second radius 33 are equal then the first and second passageways 20, 30 are unitary as there is no transition to distinguish between them.

Fluid passing through the first passageway 20 and second passageway 30 exits through outlet 32 into the inlet or entrance 41 of third passageway 40. Outlet 32 and inlet 41 are in the same plane. Third passageway 40 has an outlet or exit 42 and a third radius 43. Third passageway 40 has a length 44. Fluid passing through the exit 42 of third passageway 40 is discharged onto the surface being sprayed.

The fourth passageway 50 has an outlet 52 from the fourth passageway 50 to the third passageway 40. Outlet 52 of fourth passageway 50 is transverse to the longitudinal axis defined by centerline 15 and is preferably near or adjacent to the inlet 41 of third passageway 40. It is more preferable if outlet 52 is near or adjacent the end of transition surface 35. Fourth passageway 50 preferably has external threading 51 that mates with internal threading on the nozzle member 10 to mate fourth passageway 50 to the nozzle member 10. It is understood that fourth passageway 50 may be integrally formed with nozzle member 10. It is further understood that instead of being threadedly mated, fourth passageway 50 may be affixed to nozzle member 10 by screws, bolts, adhesives and other means known in the art. Fourth passageway 50 has an inlet 53 adapted for receiving a second fluid from a second source 55.

By placing the inlet 52 of fourth passageway 50 near the outlet 32 of the second passageway 30 and the inlet 41 of third passageway 40, the fourth passageway 50 is able to take advantage of the venturi effect. The venturi effect is the application of the well-known Bernoulli theorem to the nozzle member which predicts the formation of a low pressure region in the transition from the reduced radius nozzle area 30 to the larger radius 43 in the third passageway 40. Because of the presence of this low pressure region, fluid is drawn into third passageway 40 through fourth passageway 50 from the second source of fluid.

Figure 4:
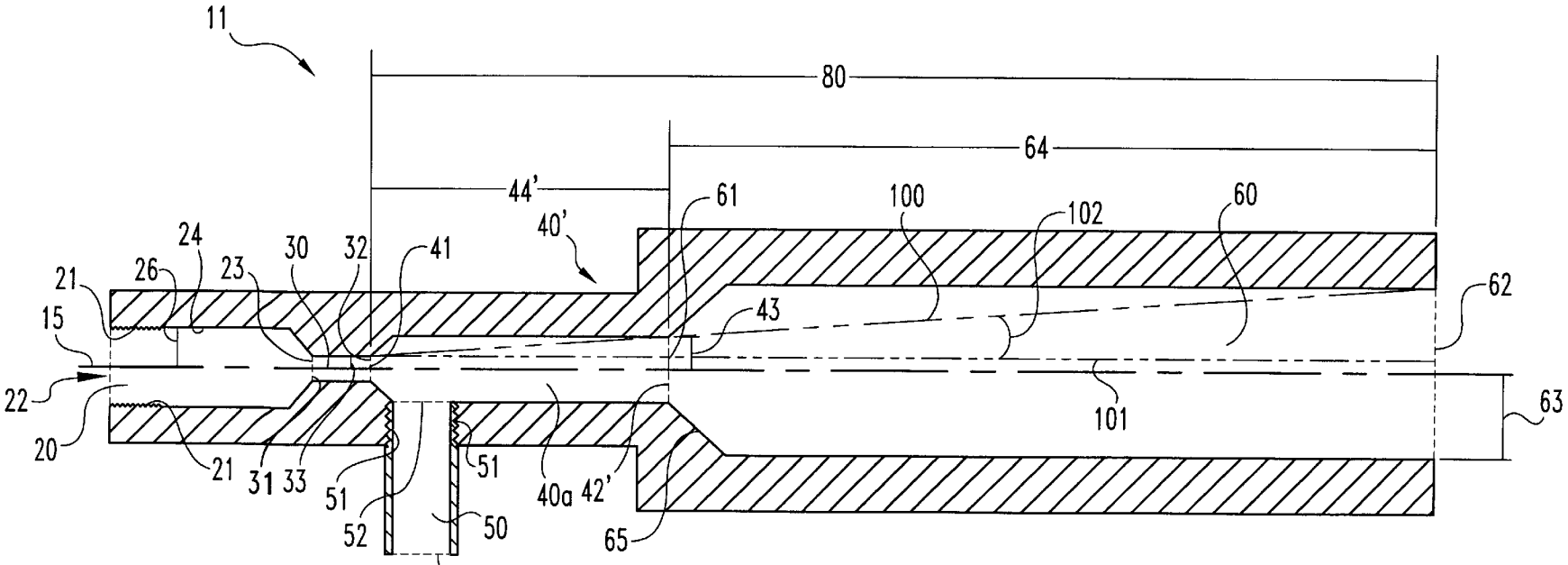
FIG. 4 is a cross sectional view of a spray nozzle having two stages in the third passageway which comprises another embodiment of the present invention.
Figure 5:
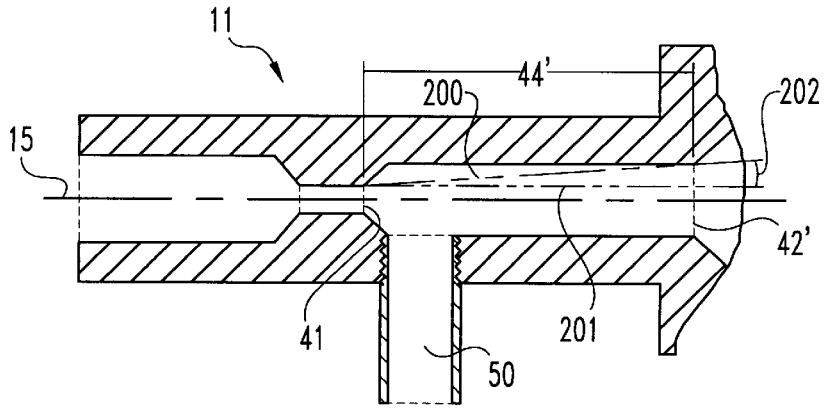
FIG. 5 is a partial cross sectional view of the spray nozzle of FIG. 4 defining an exit angle of the first stage.
Figure 6:
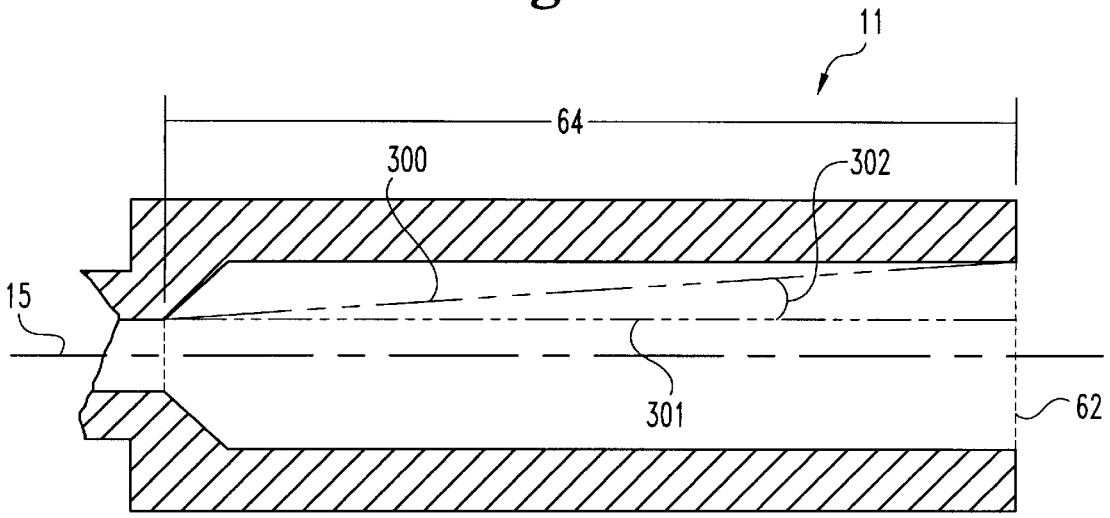
FIG. 6 is a partial cross sectional view of the spray nozzle of FIG. 4 showing how the exit angle of the second stage is defined.

With reference to FIGS. 4–6 there is shown another embodiment of the present invention, spray nozzle member 11 in which like elements are labeled as previously set forth for spray nozzle member 10. Spray nozzle member 11 includes a third passageway 40' which has a first stage **40*a* and a second stage 60. It is contemplated as within the scope of the invention that third passageway 40' may have a plurality of stages. First stage 40*a* has an outlet 42' connected to the inlet 61 of second stage 60. The outlet 62 of second stage 60 exits to the atmosphere. Second stage 60 has a fourth radius 63 and a length indicated by the line 64. The total length 80 of third passageway 40' is the sum of the length 44' of first stage 40*a* plus the length 64 of the second stage 60. With reference to FIG. 4, fourth passageway 50 is shown connected to first stage 40*a*. However, fourth passageway 50 is preferably connected to second stage 60**.

Figure 8:
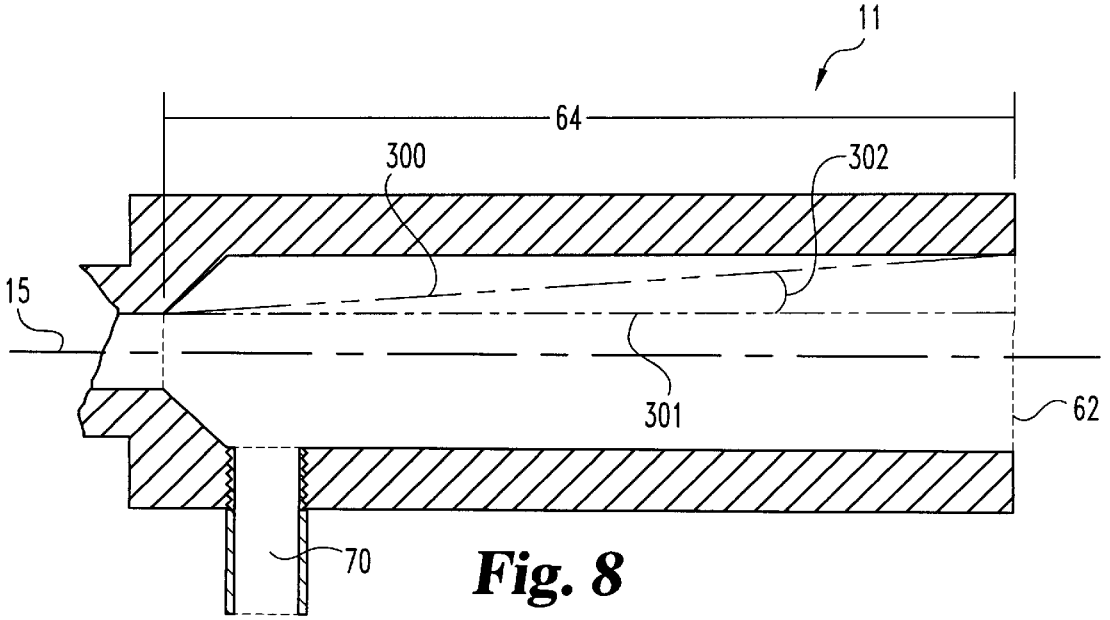
FIG. 8 is a partial cross sectional view of the spray nozzle of FIG. 7 showing how the exit angle of the second stage is defined.

In an alternative embodiment (see FIGS. 7–8) second stage 60 is connected to a fifth passageway 70. Fifth passageway 70 has an external threaded portion 71 that mates with threading on nozzle member 11. It is understood, however, that fifth passageway 70 may be integrally formed with nozzle member 11 instead of threadedly mated or may be affixed in a different manner such as by screws, bolts, adhesives or other means known in the art. Fifth passageway 70 has an inlet 73 connected to a source of a third fluid (not shown) and an outlet 72 transversely connected to second stage 60. Outlet 72 of fifth passageway 70 is connected near to or adjacent the inlet 61 and outlet 42' of the second 60 and first **40*a* stages, respectively. Thus fifth passageway 70 is also able to take advantage of a venturi effect so that fluid is drawn from a source of fluid (not shown) into the second stage 60 of third passageway 40'. The first stage 40*a* and second stage 60 are co-axial and centered along the line defining the center line 15**.

Figure 7:
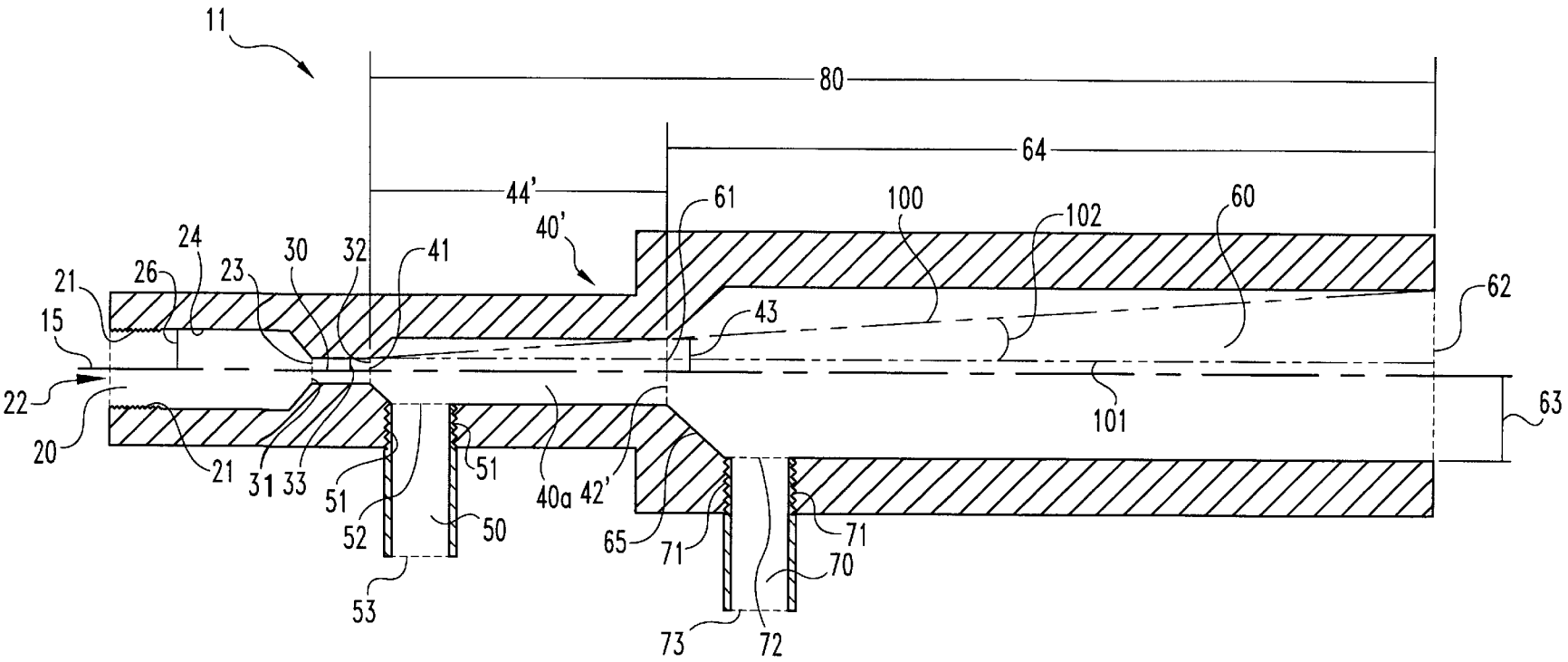
FIG. 7 is another embodiment of the spray nozzle of FIG. 4 in which the second stage is connected to a second siphon tube.

One aspect of the present invention relates to increasing flow rates of fluid drawn from the fourth passageway, and fifth passageway if present, by selection of an exit ratio in a particular range. The exit ratio is defined as the third passageway 40, 40', radius 43, 63 at exit 42, 62 divided by the second passageway 30 radius 33, at exit. 32. It is preferable to combine exit ratios in the desired range with exit angles in a particular range. With reference to FIGS. 3, 4 and 7, the exit angle 102 is defined between a first line 101 and a second line 100. First line 101 is parallel to centerline 15 and offset radially from centerline 15 so as to contact the wall defining second passageway 30. Second line 100 is a line connecting a point at inlet 41 of third passageway 40, 40' to a point on the circumference of exit 42, 62 of third passageway 40, 40'. The line 100 is in the same plane as that defined by first line 101 and centerline 15 and does not cross centerline 15.

With reference to FIGS. 2–8 another aspect of the present invention comprises having an exit ratio of greater than 2.7. Furthermore, it is preferred to use an exit ratio of greater than 2.7 in combination with an exit angle 102 between 1.1 degrees to 5.7 degrees. It is more preferable to use an exit ratio greater than 2.7 in combination with an exit angle 102 of about 3 degrees.

It is understood that the various stages of third passageway 40, such as first stage 40*a* and second stage 60, may have different exit angles 202, 302 of their own. FIGS. 4 and 7 show the exit angle 102 between the outlet 32 of second passageway 30 and the final outlet 62 of the final stage 60 of the third passageway 40'. With references to FIGS. 5, 6 and 8 the first stage 40*a* has an exit angle 202 defined by lines 201 parallel to line 15 and a line 200. Similarly the second stage in FIGS. 6 and 8 has an exit angle 302 defined by a line 301 parallel to centerline 15 and a line 300. It is preferable that exit angle 302 and exit angle 202 are equal to one another and equal to the exit angle 102. It is understood, however, that exit angles 202 and 302 may be different from one another as long as exit angle 102 is in the range of 1.1 to 5.7 degrees. Again, as with a single stage nozzle, the use of exit ratios greater than 2.7 and angles between 1.1 to 5.7 degrees allow the user to vary the flow rate of the siphoned fluid with minimal regard to the amount of air used. Herein speed of the nozzle is defined as how many seconds it takes the nozzle to evacuate a quart jar of fluid connected to the fourth passageway 50.

With reference to Tables I–IV the measured test data comparing a nozzle using various combinations of ratios and exit angles to current commercial embodiments demonstrates the superior flow rate performance available using the improvement of the present invention. Of the three variables the exit ratio, exit angle and total length, given any two the third may be determined from the formulas below which are obtained from simple geometric principles.

$$\text{tangent (exit angle)} = \frac{\text{side opposite}}{\text{side adjacent}} = \frac{R_2 - R_1}{\text{Total length}}$$

$$\text{exit ratio (102)} = \frac{R_2(43, 63)\ \text{third passageway outlet radius}}{R_1(33)\ \text{second passageway outlet radius}}$$

$$\text{exit angle} = \text{arctangent}\ [R_1(\text{exit ratio} - 1)/(\text{Total Length})]$$

$$\text{or Total Length} = R_1(\text{exit ratio} - 1) * \text{tangent (exit angle)}$$

Table I records the seconds to evacuate one quart of the second fluid, in the Table I data the fluid is water, when the first fluid is at 90 psi for a wide variety of exit ratios and exit angles. The best performance was 19 seconds to evacuate one quart at 90 psi which was obtained at a ratio of 7.14 with an angle of 4.352 degrees. In contrast, the best commercial embodiment was the device manufactured by Company D which had a ratio of 2.50 and took more than twice as long to evacuate one quart and needed an air flow rate of 11.5 CFM compared to an air flow rate of 5.5 CFM.

TABLE I

| | Present Invention Nozzle | | | | | | | | | |
|---|---|---|---|---|---|---|---|---|---|---|
| No. of Stages | (24) Intake | (43) 1st out | (63) 2nd out | (44) (44') 1st Length | (64) 2nd Length | (44) (80) Total Length | Exit Ratio | Air Flow Rate (CFM) | Exit Angle Degrees | Second/ Quart @ 90 psi |
| 2 | 0.046 | 0.093 | 0.161 | 0.340 | 0.550 | 0.890 | 3.50 | 2.5 | 3.701 | 94 |
| 2 | 0.052 | 0.101 | 0.177 | 0.255 | 0.525 | 0.780 | 3.40 | 4.0 | 4.591 | 76 |
| 2 | 0.062 | 0.120 | 0.199 | 0.222 | 0.658 | 0.880 | 3.21 | 5.0 | 4.460 | 58 |
| 2 | 0.067 | 0.191 | | | | 1.277 | 2.85 | 5.0 | 2.782 | 50 |
| 2 | | | | | | | | | | |
| 2 | 0.067 | 0.285 | | | | 1.310 | 4.25 | 5.0 | 4.767 | 32 |
| 2 | 0.070 | 0.221 | | | | 1.000 | 3.16 | 5.5 | 4.325 | 46 |
| 2 | 0.070 | 0.136 | 0.500 | 0.415 | 2.415 | 2.830 | 7.14 | 5.5 | 4.352 | 19 |
| 2 | 0.078 | 0.147 | 0.235 | 0.213 | 0.613 | 0.826 | 3.01 | 8.0 | 5.445 | 45 |
| 2 | 0.093 | 0.168 | 0.272 | 0.392 | 0.648 | 1.040 | 2.92 | 10.0 | 4.930 | 32 |
| 2 | 0.106 | 0.187 | 0.312 | 0.487 | 0.563 | 1.050 | 2.94 | 13.0 | 5.620 | 30 |
| 1 | 0.125 | 0.348 | | | | 1.483 | 2.78 | 16.0 | 4.307 | 28 |
| | | | Company A | | | | | 4.5 | | 310 |
| 1 | 0.096 | 0.240 | Company B | | | 6.550 | 2.50 | 11.0 | 0.630 | 130 |
| 1 | 0.106 | 0.187 | Company C | | | 0.562 | 1.76 | 13.0 | 4.129 | 120 |
| 1 | 0.100 | 0.250 | Company D | | | 0.840 | 2.50 | 11.5 | 5.115 | 42 |

With reference to Table II there is shown the effect for a single stage nozzle with an exit ratio of 2.85 of varying the exit angle and the consequent reduction in the number of seconds it takes to evacuate one quart of the second fluid when the first fluid is at 90 psi with a flow rate of 5.0 CFM.

TABLE II

Fixed Ratio with Varying Angle
Single Stage Intake Diameter 0.067
Single Stage Outlet Diameter 0.191
Ratio = 2.85
Air Flow Rate - 5.0 CFM

| Total Length | Degrees | Second/ Quart @ 90 psi |
|---|---|---|
| 4.202 | 0.845 | 127.00 |
| 3.292 | 1.109 | 85.00 |
| 2.202 | 1.613 | 72.00 |
| 1.702 | 2.087 | 66.00 |
| 1.277 | 2.782 | 50.00 |

TABLE II-continued

| Fixed Ratio with Varying Angle<br>Single Stage Intake Diameter 0.067<br>Single Stage Outlet Diameter 0.191<br>Ratio = 2.85<br>Air Flow Rate - 5.0 CFM | | |
|---|---|---|
| Total Length | Degrees | Second/ Quart @ 90 psi |
| 1.202 | 2.955 | 50.42 |
| 0.952 | 3.731 | 51.06 |

With reference to Table III there is shown a comparison of various commercial embodiments to the nozzle of the present invention at different input pressures.

TABLE III

| Stages | Type | Inlet Dia. | Outlet Dia. | Ratio | Nozzle Length" | Second/ Quart @ 50 psi | Second/ Quart @ 70 psi | Second/ Quart @ 90 psi |
|---|---|---|---|---|---|---|---|---|
| 1 | Company A | | | | | 419.00 | 396.00 | 310.00 |
| 1 | Company B | .096 | .240 | 2.50 | | 129.00 | 123.00 | 130.00 |
| 1 | Company C | .106 | .187 | 1.76 | | 82.00 | 84.00 | 95.00 |
| 1 | Company D | .100 | .250 | 2.50 | | 36.00 | 34.00 | 31.50 |
| 2 | | .046 | .161 | 3.50 | | 78.00 | 68.00 | 77.00 |
| 2 | | .052 | .177 | 3.40 | | 76.00 | 68.00 | 71.00 |
| 1 | | .062 | .198 | 3.21 | | 71.00 | 59.47 | 55.76 |
| 2 | | .070 | .221 | 3.16 | | 52.89 | 42.64 | 47.89 |
| 2 | | .078 | .235 | 3.01 | | 48.56 | 45.03 | 44.06 |
| | | .070 | .500 | 7.14 | | 37.40 | 26.63 | 23.80 |
| 1 | | .067 | .285 | 4.25 | | 43.12 | 33.70 | 32.70 |
| 1 | | .067 | .191 | 2.85 | 4.202 | | | 120.70 |
| | | | | | 3.202 | | | 85.00 |
| | | | | | 2.202 | | | 72.00 |
| | | | | | 1.702 | | | 60.00 |
| | | | | | 1.277 | | | 50.00 |
| | | | | | 1.202 | | | 50.42 |
| | | | | | .952 | | | 51.06 |

With reference to Table IV there is shown the theoretical calculated air flow rate in cubic feet per minute versus the actual measured air flow rate required for various inlet diameters.

TABLE IV

| Inlet Diameter | Actual CFM | Calculated CFM |
|---|---|---|
| 0.046 | 2.5 | 3.30 |
| 0.052 | 4.0 | 4.70 |
| 0.062 | 5.0 | 5.90 |
| 0.070 | 5.5 | 7.40 |
| 0.078 | 8.0 | 9.17 |
| 0.093 | 10.0 | 13.10 |
| 0.106 | 13.0 | 16.85 |
| 0.125 | 16.0 | 23.50 |

Data on the required gauge pressure for the orifice or first inlet and the horsepower of a compressor required to generate various pressures may be found in "Catalog A Compressors Accessories Tool and Equipment Air Engineering Data" copyright 1978 by the *Association of Ingersoll-Rand Distributors* which is herein incorporated by reference.

The advantages and benefits of nozzles constructed according to the present invention are easily seen in the experimental data of Tables I–IV. The nozzle speed or siphon rate of a nozzle constructed according to the present invention is much improved and relatively insensitive to air flow rates. Additionally, the nozzle of the present invention works well even for low air flow rates below 8.5 CFM. This is advantageous for reasons discussed below.

The largest 110 volt compressors currently available use approximately 15 amps of electricity for the motor. This is a 2 horsepower motor and will only produce 8.5 CFM of air at typical operating pressures. Testing has shown that using a nozzle with an inlet or intake diameter of 0.078 inches required 8.0 CFM of air as measured by a flow meter. Using a 0.078 inch intake diameter the conventional prior art 2.5 to 1 ratio technology would translate to a maximum output of 0.195 for the home market. The home market is defined by those systems which can use a conventional 110 volt compressor as opposed to requiring a larger (220 volt and up) compressor. Virtually all existing spray nozzles use a 0.093 inch diameter intake or larger. Moreover the smallest nozzle intake diameter of 0.096 inches of Company A tended to perform poorly because of its long length which causes it to spit irregularly.

Sprayers with nozzles using 0.093 inch and larger diameters for the intake tube require a 220 volt compressor to produce enough cubic feet per minute of air to keep up with the nozzle. While almost any sprayer may be used on a 110 volt compressor for a short burst of air between 60 psi and 90 psi, current commercially available nozzles need higher air flow rates which a 110 volt compressor cannot produce for continuous operation. In contrast, a nozzle constructed according to the present invention requires lower air flow rates to sustain equal if not better nozzle speeds and thus is capable of continuous operation using a 110 volt compressor. Thus it is particularly desirable for use in the home market. For example, with reference to Table I, the Company D nozzle was the best performing of the commercial embodiments tested and required an air flow rate of 11.5 CFM and had an intake diameter of 0.100 inches which would require at least a 220 volt compressor for continuous operation.

Applications of the nozzle of the present invention include, but are not limited to, spray systems such as a cleaning spray gun, a wash down gun, paint spraying and more. Different applications will have different spray atomization requirements. The nozzle with an intake diameter of 0.070 inches and outlet diameter of 0.500 inches and an air flow rate of 5.5 CFM was a much heavier and wetter spray in part due to the high nozzle speed of 19 sec/quart. In applications such as spraying paint better misting or atomization qualities are desirable. Good misting was obtained for nozzles with ratios between 3 to 3.5. For example the nozzles in Table I with intake diameters of 0.052 and 0.062 having ratios of 3.4 and 3.21 respectively sprayed paint with good misting.

Additionally, this design does not require any boost air. A conventional paint gun requires a pressure pot to supply boost air which pushes the paint into the air stream. It is preferable to construct the nozzle without a pressure pot. It is understood, however, that a pressure pot may nonetheless be used if desired. It should be noted that nozzles of the present invention work for nearly all pressures. However, effective atomization does not occur at low pressures and the nozzles do not draw fluid out of the fourth passageway as well above ninety psi of pressure. It is preferable to use sixty to ninety psi for thin liquids, and often to use over one hundred ten psi when painting.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A spray nozzle comprising:

a main body having a first, second, third, and fourth passageways, said first passageway having a first inlet and a first outlet and a first width, said first inlet adapted for receiving a first pressurized fluid from a first pressure source, said second passageway having a second inlet and a second outlet and a second width, said third passageway having a third inlet and a third outlet and a third width, said fourth passageway having a fourth inlet and a fourth outlet and a fourth width, said fourth inlet adapted for receiving a second fluid from a second source, said fourth outlet being connected to said third passageway near enough to said third inlet so that said second fluid is drawn into said third passageway and mixes with said first fluid, said third outlet exiting to a surrounding atmosphere;

said first, second, and third passageways being in end to end fluid communication with one another;

wherein an exit ratio of said third width divided by said second width is between 3.0 and 11.0; and, wherein said third passageway has an exit angle, said exit angle defined between a first line and a coplanar second line, said first line located at a radius of said second passageway and parallel to said centerline, said second line connecting a first point on the circumference of said second outlet to a second point on the circumference of said third outlet, said second line intersecting said first line only at said second outlet, said exit angle being between 1.1 and 5.7 degrees.

2. The nozzle of claim 1, wherein said third passageway has a plurality of stages between said third inlet and said third outlet.

3. The nozzle of claim 1, wherein said first pressure source is for pressurizing a gas and said second source is a receptacle adapted for retaining a liquid.

4. The nozzle of claim 3, wherein said gas is air and said liquid is paint.

5. The nozzle of claim 3, wherein said gas is air and said liquid is a cleaning solution.

6. The nozzle of claim 1, wherein the first pressurized fluid is pressurized by a 110 volt compressor.

7. The nozzle of claim 1, wherein said first width is no greater than 0.078 inches.

8. The nozzle of claim 1, wherein said exit ratio is between 3 to 7.2.

9. The nozzle of claim 8, wherein said exit angle is between 1.1 to 3.0 degrees.

10. The nozzle of claim 8, wherein said exit angle is between 3.0 to 5.7 degrees.

11. The nozzle of claim 1, wherein said first and second widths are equal so that said first passageway and said second passageway are unitary.

12. The nozzle of claim 1, wherein said exit ratio is between 3 to 7.2, said exit angle is between 3.0 to 5.7 degrees, and said first width is no greater than 0.078 inches.

13. A spray nozzle comprising:

a first, second, third, and fourth duct with a first, second, third, and fourth inlet, outlet, and width respectively;

said first, second, and third ducts being in end to end fluid communication with one another, said first inlet being adapted for receiving a first pressurized fluid from a first pressure source, said fourth inlet being adapted for receiving a second fluid from a second source, said fourth outlet being connected to said third duct near enough to said third inlet so that said second fluid is drawn into said third duct and mixes with said first fluid, said third outlet exiting to a surrounding atmosphere;

said nozzle having an exit ratio defined by said third width divided by said second width;

said third duct having an exit angle defined between a first line and a coplanar second line, said first line located at a radius of said second passageway and parallel to said centerline, said second line connecting a first point on the circumference of said second outlet to a second point on the circumference of said third outlet, said second line intersecting said first line only at said second outlet; and, wherein said exit angle is between 2.2 and 5.7 degrees and said exit ratio is between 2.7 and 11.0.

14. The nozzle of claim 13, wherein said third duct has a plurality of stages between said third inlet and said third outlet.

15. The nozzle of claim 13, further including a fifth duct having a fifth inlet and a fifth outlet, said fifth inlet adapted for receiving a third fluid from a third source, said third duct having a first stage and a second stage, said first stage being connected to said fourth outlet, said second stage being connected to said fifth outlet.

16. The nozzle of claim 13, wherein said exit ratio is between 3.0 to 7.2, said exit angle is between 3.0 to 5.7 degrees, and said first width is less than 0.078 inches.

17. A spray nozzle comprising:

a first, second, third, and fourth passageway having a first, second, third and fourth inlet, outlet, and width respectively, said first inlet being adapted for receiving a first pressurized fluid from a first pressure source, said fourth inlet being adapted for receiving a second fluid from a second source, said passageways being configured so that said second fluid is drawn into said third passageway by a venturi effect; and, means for maximizing the delivery of said second fluid into said third passageway.

18. The spray nozzle of claim 17, wherein said means for maximizing includes using a third passageway having an exit ratio between 2.7 and 11.0, and an exit angle between 2.2 and 5.7 degrees.

19. The spray nozzle of claim 17, wherein said means for maximizing includes using a third passageway having an exit ratio between 3.0 and 11.0; and an exit angle between 1.1 and 5.7 degrees.

20. A spray nozzle comprising:

a main body having a first, second, third, and fourth passageways, said first passageway having a first inlet and a first outlet and a first width, said first inlet adapted for receiving a first pressurized fluid from a first pressure source, said second passageway having a second inlet and a second outlet and a second width, said third passageway having a third inlet and a third outlet and a third width, said fourth passageway having a fourth inlet and a fourth outlet and a fourth width, said fourth inlet adapted for receiving a second fluid from a second source, said fourth outlet being connected to said third passageway near enough to said third inlet so that said second fluid is drawn into said third passageway and mixes with said first fluid, said third outlet exiting to a surrounding atmosphere;

said first, second, and third passageways being in end to end fluid communication with one another;

wherein an exit ratio of said third width divided by said second width is between 3.0 and 11.0; and, wherein said third passageway has an exit angle, said exit angle defined between a first line and a coplanar second line, said first line located at a radius of said second passageway and parallel to said centerline, said second line connecting a first point on the circumference of said second outlet to a second point on the circumference of said third outlet, said second line intersecting said first line only at said second outlet, said exit angle being between 1.1 and 5.7 degrees; and, further including a fifth passageway having a fifth inlet and a fifth outlet, said fifth inlet adapted for receiving a third fluid from a third source, said third passageway having a first stage and a second stage, said first stage being connected to said fourth outlet, said second stage being connected to said fifth outlet.

21. The nozzle of claim 20, wherein said first fluid is air, said second fluid is either water or a cleaning agent and said third fluid is the other of water or a cleaning agent.

22. The nozzle of claim 20, wherein said first pressure source is for pressurizing a gas and said second source is a receptacle adapted for retaining a liquid.

23. The nozzle of claim 22, wherein said gas is air and said liquid is paint.

* * * * *